US008186055B2

(12) United States Patent
Krebs et al.

(10) Patent No.: US 8,186,055 B2
(45) Date of Patent: May 29, 2012

(54) METHODS FOR MANUFACTURING PUMP-HEADS HAVING A DESIRED INTERNAL CLEARANCE FOR ROTARY MEMBER

(75) Inventors: Larry F. Krebs, Vancouver, WA (US); Craig Sunada, Black Diamond, WA (US); Steven E. Owen, Vancouver, WA (US)

(73) Assignee: Micropump, Inc., Vancouver, WA (US)

( * ) Notice: Subject to any disclaimer, the term of this patent is extended or adjusted under 35 U.S.C. 154(b) by 943 days.

(21) Appl. No.: 12/201,842

(22) Filed: Aug. 29, 2008

(65) Prior Publication Data

US 2009/0056124 A1 Mar. 5, 2009

Related U.S. Application Data

(60) Provisional application No. 60/967,214, filed on Aug. 30, 2007.

(51) Int. Cl.
*B23P 11/00* (2006.01)
*B23P 15/00* (2006.01)
*F04B 17/00* (2006.01)

(52) U.S. Cl. ..... 29/888.025; 29/888.02; 29/434; 417/410.4

(58) Field of Classification Search ..... 29/888.02, 29/888.025, 434; 417/410.4, 410.3
See application file for complete search history.

(56) References Cited

U.S. PATENT DOCUMENTS 4,370,110 A 1/1983 Nagely
4,674,772 A * 6/1987 Lycan ..... 285/22
2007/0071616 A1 3/2007 Owen et al.

FOREIGN PATENT DOCUMENTS

JP 354122646 9/1979

OTHER PUBLICATIONS

International Search Report and Written Opinion of the International Searching Authority, mailed Dec. 5, 2008, from PCT Application No. PCT/US2008/074877.

* cited by examiner

*Primary Examiner* — Alexander P Taousakis
(74) *Attorney, Agent, or Firm* — Klarquist Sparkman, LLP

(57) ABSTRACT

Various methods are disclosed for manufacturing pump-heads having a housing enclosing at least one rotary member. In an exemplary method first and second housing portions are provided that collectively, when assembled, define a pump-cavity that accommodates the rotary member(s). The rotary member(s) is assembled into the pump-cavity, along with at least one soluble spacer of a defined thickness that corresponds to a desired clearance of the rotary member relative to the pump-cavity. The spacer contacts a surface of the rotary member facing a corresponding surface of the housing portion. The first and second housing portions are attached together to form the pump-cavity containing the rotary member(s). The soluble spacer is dissolved to provide the desired clearance of the rotary member in the pump-cavity. As the housing portions are attached together, e.g., by adhesive bonding, the spacer establishes the desired clearance of the rotary member(s) in the pump-cavity.

16 Claims, 3 Drawing Sheets

METHODS FOR MANUFACTURING PUMP-HEADS HAVING A DESIRED INTERNAL CLEARANCE FOR ROTARY MEMBER

This application claims priority to, and the benefit of, U.S. Provisional Application No. 60/967,214, filed on Aug. 30, 2007, and incorporated by reference herein in its entirety.

FIELD

This application pertains to, inter alia, gear pumps and other pumps having one or more rotary members situated inside a pump housing and used for pumping a fluid in a hydraulic system. Certain embodiments pertain to gear pumps that are magnetically driven and have sealed housings.

BACKGROUND

For pumping liquids and other fluids, gear pumps and the like have experienced substantial acceptance in the art due to their comparatively small size, quiet operation, reliability, and cleanliness of operation with respect to the fluid being pumped. Gear pumps also are advantageous for pumping fluids while keeping the fluids isolated from the external environment. This latter benefit has been further enhanced with the advent of magnetically coupled pump-drive mechanisms that have eliminated leak-prone and unreliable shaft seals, i.e., dynamic hydraulic seals around rotating pump-drive shafts.

Gear pumps have been adapted for use in many applications, including applications requiring extremely accurate delivery of a fluid to a point of use. Such applications include, for example, delivery of liquids in medical and scientific instrumentation. Another application is the delivery of coolant liquids to a location where the coolant liquid can be used for active cooling or temperature control of an object.

With respect to cooling systems, an emerging application of gear pumps and the like is circulated-liquid cooling of microelectronic devices. Particularly demanding aspects of this application include extremely tight spatial constraints for accommodating a liquid cooling system including a pump, extremely high reliability specifications that must be met, minimal cost, and very low energy budget for running the pump.

Ongoing efforts in these and other demanding applications have stimulated interest in development of gear pumps that are smaller, more reliable, less expensive, and more energy-efficient. As gear pumps have been miniaturized to meet these criteria, certain technical challenges have arisen.

One technical challenge pertains to manufacturing the pump-head housing of a light-weight and durable material that is intrinsically low in cost, that can be formed easily and inexpensively, and that holds its dimensions over a long period of time. In this regard, the stainless steel or other metal conventionally used for fabricating larger, conventional pump-head housings has been replaced in many instances with reinforced thermoset plastic. Use of plastic reduces weight substantially and eliminates most if not all the machining steps used in making conventional pump-head housings of metal. The reinforcement (e.g. fibers) provides dimensional and structural stability and durability. Also, compared to metal, plastic is intrinsically lower in cost and advantageously can be molded, which further reduces manufacturing costs.

In addition to use for making miniature pump-head housings, plastic or other suitable is also being used for making the gear set enclosed within a "gear cavity" or "pump-cavity" in the housing of the gear pump-head. Even very small gears made of plastic exhibit high reliability and durability for certain applications. Also, as in conventional magnetically driven gear pump-heads, plastic is used for fabricating the magnet cup of miniature pump-heads. The magnet cup is a sealable enclosure for an axially rotatable magnet that is mechanically coupled to one of the gears (the "driving gear") and magnetically coupled to a driver (usually configured as a coaxial stator) situated outside the magnet cup. The rotating magnetic field produced by the driver passes through the walls of the magnet cup to the magnet to cause rotation of the magnet. The interior of the magnet cup (including the magnet) is usually bathed by the liquid being pumped by the pump-head, and hence is hydraulically coupled to the gear cavity.

Another technical challenge pertains to tolerance stack-up. As parts of the pump-head are reduced in size, the dimensional tolerances of each part become tighter and more difficult to achieve and control. Also, the tolerances in individual parts "stack-up" as multiple parts are assembled into a pump-head. For example, dimensional tolerances of individual housing parts and rotary members that can be accommodated in a conventional pump-head are intolerable in a miniature pump-head that is five to ten times smaller. Problems with tolerance stack-up arise no matter how the parts are fabricated, whether by molding or machining, and without regard to the particular material from which the parts are fabricated. Also, costs rise substantially in close-tolerance fabrication processes, including molding.

Tolerance issues arise in all the dimensions of miniature parts. For example, a pump-head housing normally comprises at least several housing portions that must be very accurately aligned with each other and with other parts (e.g. the gears and magnet cup) during assembly. Conventional alignment aids include use of alignment pins, mechanical fasteners, or the like, especially if permissible from a cost standpoint. But, with substantial miniaturization of the pump-head, alignment pins become too small to be effective and/or usable in many instances (and the need to hold tight tolerances on the pins themselves makes them prohibitively expensive to manufacture). Hence, there are practical limits to the closeness by which tolerances can be held in miniature parts fabricated by conventional methods and to the tolerance stack-ups that inevitably result when the parts are assembled together. These limits (and the costs associated with overcoming them) must be addressed as miniaturization goals continue to be pursued.

Yet another technical challenge with miniature pump-heads is establishment and maintenance of adequate static seals between housing portions. In conventional larger pump-head housings, O-rings or the like are used to form static seals between mating housing portions. Miniaturization of pump-head housings has required corresponding reductions in the size and thicknesses of O-rings that can be used. This, in turn, raises tolerance problems in molding the O-rings and in forming the glands in which the O-rings are placed for use in forming static seals.

In miniature pump-heads the clearance of the gears or other rotary members relative to the cavity defined in the housing is also a critical issue. For example, gear clearance relative to the housing is directly related to tolerance stack-ups involving the gears as well as the parts of the housing defining the gear cavity. This clearance issue pertains not only to radial clearance of the gears in the gear cavity but also to axial (end) clearance of the gears relative to end walls of the gear cavity. In miniature pump-heads these clearance windows can be tens of microns or less. Excessive clearance (radially and/or axially) can cause the pump-head to exhibit excessive back-flow. "Negative"clearance (i.e., no clearance at all) can result in the gears being bound-up in the housing, which renders the pump-head inoperable. Thus, the difference between too much clearance and insufficient (or even negative) clearance can be extremely small and difficult to control by conventional methods. Since no two identical parts have exactly the same dimensions, due to manufacturing tolerances, and since every component part of a pump-head has its own tolerances, the tolerance stack-up from one pump-head to the next on a manufacturing line can make achieving the right clearance every time nearly impossible when using conventional methods to fabricate miniature pump-heads.

SUMMARY

In view of the foregoing, this disclosure provides, inter alias methods for manufacturing a pump-head including a housing enclosing at least one rotary member. An embodiment of such a method includes steps summarized as follows: First and second housing portions are provided that collectively, when assembled together, define a pump-cavity that accommodates the rotary member(s). The rotary member(s) is assembled into the housing portions so as to be situated in and rotatable within the pump-cavity. Also placed in the pump-cavity is at least one soluble spacer of a defined thickness that corresponds to a desired clearance of a rotary member relative to the pump-cavity. The spacer is placed in contact with a surface of the rotary member facing a corresponding surface of at least one of the housing portions. The first and second housing portions are then attached together to form the pump-cavity containing the rotary member(s). Then, the soluble spacer is dissolved to provide the desired clearance of the rotary member in the pump-cavity. As the housing portions are attached together, e.g. by bonding such as adhesive bonding, the spacer establishes the desired clearance of the rotary member(s) in the pump-cavity. By way of example, the spacer can be made of a material that is water-soluble.

The housing portions need not be identical in shape or size. At least two portions are typically used so that, when not yet attached together, they define locations at which to place the at least one rotary member and any additional components (e.g., bushings and/or axles). When the portions are subsequently attached together, they define the pump-cavity containing the at least one rotary member and the additional components.

A key application of the subject methods is to the production of gear pump-heads, in which the rotary members are respective gears. However, the methods are not limited to production of gear pump-heads. For example, the at least one rotary member comprises two pump gears, namely a driving gear interdigitated (meshed) with a driven gear. With such pump-heads, the assembling step comprises mounting the pump gears in the pump-cavity before attaching the first and second housing portions together. With pump gears, the desired clearance typically (but not exclusively) is a desired end-clearance of the gears relative to corresponding locations on an inside surface of the pump-cavity. End-clearance can be established by configuring the spacers as soluble washers that are placed coaxially with respective gears to establish the desired end-clearance between the sides of the gears and the corresponding inside surfaces of the pump-cavity.

As the housing portions are urged toward each other, they can be subjected to a predetermined preload (force with which they are urged together). A specified preload helps ensure that the spacer(s) are seated between the respective rotary member(s) and the corresponding surface(s) of the pump-cavity. So long as the spacers are manufactured to a specified thickness, proper seating of them ensures the desired clearance (corresponding to the thickness) after the spacer(s) are dissolved. Preload is typically applied, if at all, at least during execution of the technique used for attaching the housing portions together. For example, if the housing portions are attached together using an adhesive, preload desirably is applied at least after application of the adhesive and can be continued during curing of the adhesive.

Attaching the housing portions together can be performed using any of several techniques not limited to adhesive bonding. By way of example, and not intending to be limiting, these alternative techniques include heat-bonding, sonic welding, use of mechanical fasteners, etc. These techniques (as well as the adhesive technique) are especially useful if the housing portions are made of a plastic material, but the techniques can also be used with metal housings. If the housing portions are made of metal, then other techniques alternatively can be used such as, but not limited to, soldering or brazing. The housing portions desirably have sufficient rigidity, and the attachment technique desirably is sufficiently stable, to ensure that the predetermined clearance established by the spacer(s) remains appropriately constant after the spacer(s) have been dissolved away.

The method can further comprise mounting a rotation device to the pump-head such that the rotation device is coupled to the at least one rotary member. The rotation device typically is energizable in a manner that causes rotation of the rotary member(s) in the pump-cavity. By way of example, the rotation device can comprise a rotatable magnet, that is coupled to at least one rotary member, and a magnet driver magnetically coupled to the rotatable magnet. In such an event, the assembling step can include enclosing the magnet in a magnet cup and mounting the magnetic cup to at least one of the housing portions such that the magnet cup is in hydraulic communication with the pump-cavity.

The spacer(s) typically are dissolved by circulating a solvent in the assembled pump-head. A particularly convenient solvent is water, which requires that the spacers be made of a water-soluble material. Meanwhile, the rotary member(s) can be rotated to facilitate dissolution of the spacer(s).

Another method embodiment is directed to a method for manufacturing a gear pump-head. The method comprises providing a first housing portion and a second housing portion that collectively, when assembled, define a gear-cavity. At least two gears (a driving gear and a driven gear) are assembled into the housing portions, more specifically in the gear-cavity. At least one soluble spacer, having a defined thickness corresponding to a desired end-clearance, is placed in contact with at least one surface of the gears facing at least one of the housing portions in the gear-cavity. After assembling these and any other required components in the gear-cavity, the first and second housing portions are attached together to form the gear-cavity containing the gears and other components. This attaching step includes urging the first and second housing portions toward each other until stopped by the soluble spacer. The soluble spacer is then dissolved in the gear-cavity to provide the desired end-clearance of the respective gear(s) in the gear-cavity.

To attach the housing portions together, adhesive can be used. In such an event, the method can include the steps of applying adhesive to mating surfaces of the first and second housing portions, and curing the adhesive after attaching the first and second housing portions together.

The method can further comprise the step of mounting a rotatable magnet to the driving gear, and enclosing the magnet in a magnet cup mounted to at least one of the housing portions and in fluid communication with the gear-cavity.

Yet another embodiment of a method, first and second housing portions are provided as summarized above. At least one rotary member is assembled in the housing portions in a manner by which the rotary member(s) is rotatable in the pump-cavity. The first and second housing portions are attached together to form the pump-cavity containing the rotary member(s) such that each rotary member contacts a corresponding surface of the pump-cavity. The rotary member(s) in the pump-cavity are actuated (rotated) to reduce an internal interference between the rotary member(s) and the corresponding surface(s) of the pump-cavity. By causing motion of the rotary member(s) relative to the surface(s) of the pump-cavity, high-points and other microscopic irregularities in the surfaces of the rotary member(s) and pump-cavity surfaces are eroded and smoothed out, thereby establishing a very close-tolerance clearance between the rotary member(s) and pump-cavity surfaces on a consistent basis from one pump-head to the next on an assembly line.

As noted above, the rotary member(s) can be a driving gear enmeshed with at least one driven gear. In such an event, the actuating step reduces an internal interference between the gears and respective surfaces of the housing portions, to provide desired respective end-clearances of the gears inside the pump-cavity.

The attaching step desirably comprises urging the first and second housing portions toward each other until stopped by contact of the housing portions against respective facing surfaces of the gears. This urging desirably is at a specified preload. The housing portions are bonded or otherwise connected together, wherein the preload desirably is applied at least during a portion of the time that the bonding or the like is being performed.

This method embodiment can be combined with the first embodiment summarized above, in which during the assembling step, a soluble spacer is placed between the rotary member and a corresponding surface of the pump-cavity. After the attaching step, the spacer is dissolved.

The foregoing and other objects, features, and advantages of the invention will become more apparent from the following detailed description, which proceeds with reference to the accompanying figures.

DETAILED DESCRIPTION

Figure 1A:
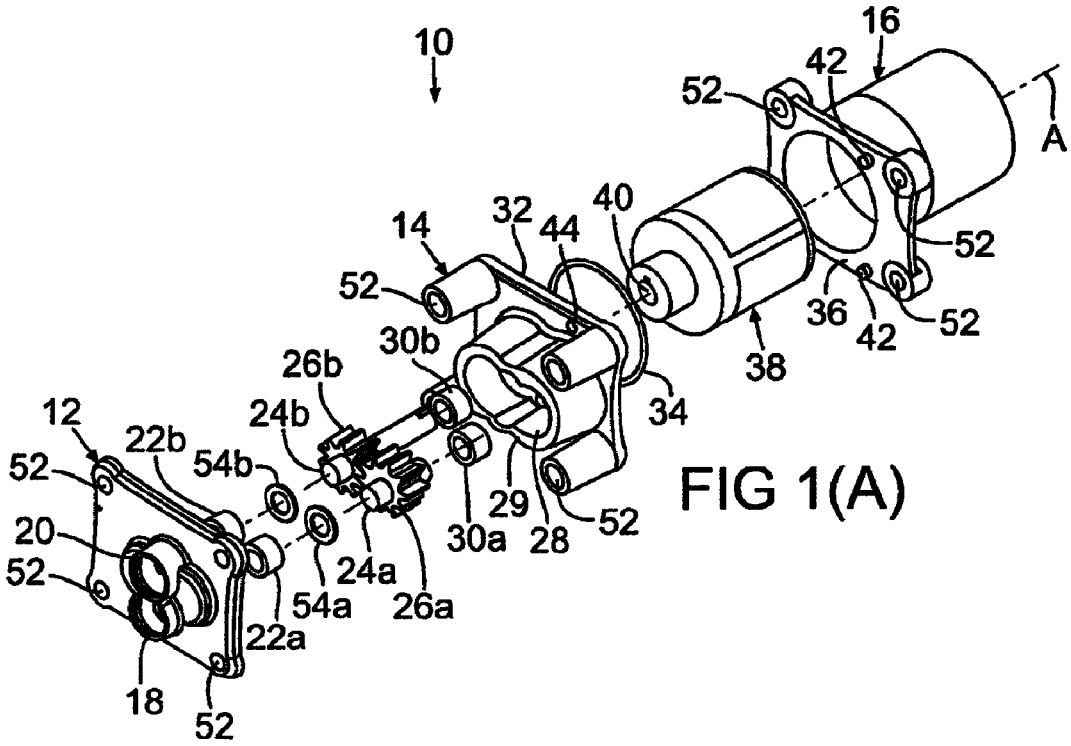
FIG. 1(A) is a perspective, axially exploded view of a gear pump-head according to the first representative embodiment.

This invention addresses and solves the problems articulated above, especially with respect to miniature gear pump-heads and other pump-heads including one or more rotary members. Namely, inter alia, methods are provided that solve these problems.

This disclosure is set forth in the context of representative embodiments that are not intended to be limiting in any way.

As used herein, the singular forms "a," "an," and "the" include the plural forms unless the context clearly dictates otherwise. Additionally, the term "includes" means "comprises." Further, the term "coupled" encompasses mechanical as well as other practical ways of coupling or linking items together, and does not exclude the presence of intermediate elements between the coupled items.

The described things and methods described herein should not be construed as being limiting in any way. Instead, this disclosure is directed toward all novel and non-obvious features and aspects of the various disclosed embodiments, alone and in various combinations and sub-combinations with one another. The disclosed things and methods are not limited to any specific aspect or feature or combinations thereof, nor do the disclosed things and methods require that any one or more specific advantages be present or problems be solved.

Although the operations of some of the disclosed methods are described in a particular, sequential order for convenient presentation, it should be understood that this manner of description encompasses rearrangement, unless a particular ordering is required by specific language set forth below. For example, operations described sequentially may in some cases be rearranged or performed concurrently. Moreover, for the sake of simplicity, the attached figures may not show the various ways in which the disclosed things and methods can be used in conjunction with other things and method. Additionally, the description sometimes uses terms like "produce" and "provide" to describe the disclosed methods. These terms are high-level abstractions of the actual operations that are performed. The actual operations that correspond to these terms will vary depending on the particular implementation and are readily discernible by one of ordinary skill in the art.

In the following description, certain terms may be used such as "up," "down,", "upper," "lower," "horizontal," "vertical," "left," "right," and the like. These terms are used, where applicable, to provide some clarity of description when dealing with relative relationships. But, these terms are not intended to imply absolute relationships, positions, and/or orientations. For example, with respect to an object, an "upper"surface can become a "lower" surface simply by turning the object over. Nevertheless, it is still the same object.

Various embodiments of the methods have one or more of the following characteristics: (a) substantial elimination of mechanical fasteners, such as screws or the like, as well as substantial elimination of separate alignment pins to reduce parts count and hence cost; (b) incorporation of one or more alignment features into certain parts to achieve accuracy of part-to-part alignment without having to use separate alignment features or components; (c) to achieve a desired end-clearance of a rotary member(s) in its housing, a thin, soluble, temporary spacer is placed between the rotary member and an inside surface of the housing during assembly, and the spacer is subsequently dissolved to establish the desired clearance between the rotary member(s) and the housings; (d) to achieve a desired end-clearance of the rotary member(s) in the housing, the rotary member(s) is assembled in the pump-cavity, and the housing portions are assembled while pressing them together axially, followed by running the rotary member(s) under pressure to remove high-spot interferences between the rotary member(s) and an inside surface of the housing, to establish a desired end-clearance; and (e) to achieve part-to-part fastening and liquid sealing, the mating portions of the housing are bonded together using a suitable adhesive or other bonding technique appropriate for the material of which the housing is made. The subject methods are particularly suitable for high-volume production of miniaturized pump-heads while achieving desired levels of reliability and durability of miniaturized, hermetically sealed, magnetically driven pumps.

Various embodiments are described in the context of gear pump-heads in which the rotary members (usually at least two per housing) are interdigitated gears that rotate about parallel axes. But, it will be understood that the principles described herein are also applicable to pump-heads in which other types of rotary members are used such as centrifugal rotors, lobed rotors, rotary pistons, etc., are used.

Various embodiments are described in the context of at least the housing being made of a suitable plastic material. However, it will be understood that the principles described herein are also applicable to housings being made of any of various other materials such as, but not limited to ceramic, metal, semiconductor, glassy material, etc.

First Representative Embodiment

Figure 1B:
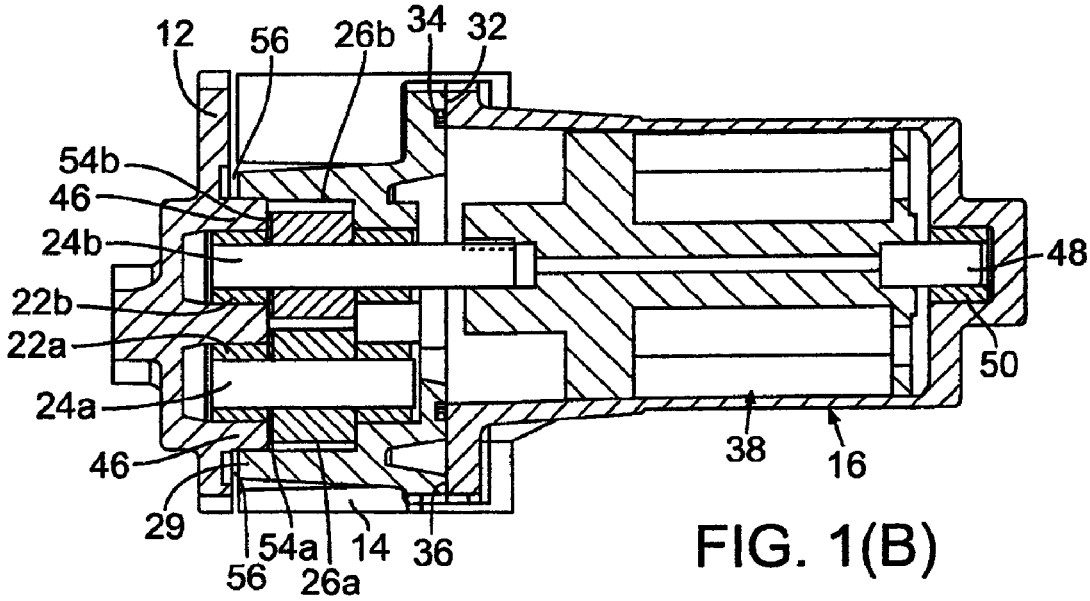
FIG. 1(B) is an elevational section (along the median sagittal plane) of the assembled gear pump-head of the first representative embodiment.

This first embodiment is directed to a method for manufacturing a pump-head, in which a desired end-clearance of the rotary member(s) in the housing is achieved during manufacture. The embodiment as applied to manufacture of a gear pump-head is shown in FIGS. 1(A) and 1(B). Turning first to FIG. 1(A), an exploded view of the subject pump-head assembly 10 is shown. The pump-head assembly 10 of this embodiment is a magnetically driven gear pump that comprises a first housing portion (end-plate) 12, a second housing portion (cavity-plate) 14, and a magnet cup 16 disposed along an axis A. The end-plate 12 includes an inlet port 18 and an outlet port 20. The end-plate 12 is configured with gear bushings 22*a*, 22*b* into which corresponding gear axles 24*a*, 24*b* are journaled. Respective gears 26*a*, 26*b* are attached to the gear axles 24*a*, 24*b*. The gear 26*a* is the "driven" gear, and the gear 26*b* is the "driving" gear. The gears 26*a*, 26*b* interdigitate with each other such that rotation of the driving gear 26*b* causes contra-rotation of the driven gear 26*a*. The interdigitated gears 26*a*, 26*b* are enclosed in a gear cavity 28 defined by an integral "figure-eight"wall 29 of the cavity-plate 14. The gear axles 24*a*, 24*b* are journaled in respective bushings 30*a*, 30*b* mounted in the cavity-plate 14. The gear axle 24*b* extends through the cavity-plate 14 into the magnet cup 16. The assembly comprising the end-plate 12, the cavity plate 14, and the enclosed gears 26*a*, 26*b* is termed a "gear pump-head."

The magnet cup 16 of this embodiment includes a facing surface 36 that is mounted to the rear-facing surface 32 of the cavity-plate 14. A static seal 34 is situated between the surfaces 32, 36. The magnet cup 16 encloses a magnet 38, which includes an axial keyed opening 40 into which the gear axle 24*b* is inserted. Thus, rotation of the magnet 38 about the axis A causes corresponding rotation of the gear axle 24*b* and hence of the driving gear 26*b*. The magnet cup 16 includes integral alignment pins 42 that are inserted, during assembly, into corresponding holes 44 defined in the rear-facing surface 32 so that the magnet cup aligns accurately with the cavity-plate 14. The magnet 38 of this embodiment is bathed with the fluid being pumped by the pump-head assembly 10 as the fluid circulates inside the magnet cup 16.

The end-plate 12 of this embodiment defines a "figure-eight" raised face 46 that slip-fits into the gear cavity 38 during assembly (FIG. 1(B)), which serves to align the plates 12, 14 with each other. The magnet 38 includes an axle portion 48 journaled in a bushing 50 in the bottom of the magnet cup 16. The magnet cup 16 and housing portions 12, 14 can be fastened together using screws, clips, or other mechanical fasteners (not shown) that extend through mounting holes 52. Alternatively, the magnet cup 16 can be fastened to the housing portion 14 using mechanical fasteners, while the housing portions 12, 14 are bonded together (see below). Further alternatively, all three components 12, 14, 16 can be bonded together. Further alternatively, these components can be both bonded together and fastened together.

The bushings 22*a*, 22*b*, 30*a*, 30*b* are shown in FIGS. 1(A) and 1(B) as separate parts that are mounted to the plates 12, 14, respectively, but made of a different material than the plates 12, 14. Alternatively, the bushings can be integral with, and/or made of the same material as, the respective plates.

Without intending to be limiting in any way, exemplary materials are: fiber-reinforced polyetherimide for the plates 12, 14 and magnet cup 16; thermoplastic polyimide for the gears 26*a*, 26*b* and bushings 22*a*, 22*b*, 30*a*, 30*b*; and yttria-stabilized zirconia for the axles 24*a*, 24*b*.

During assembly of a gear pump-head using a method according to this embodiment, thin spacers 54*a*, 54*b* are situated on the face of each gear 26*a*, 26*b*, respectively (FIG. 1(A)). The spacers 54*a*, 54*b* are used to establish a desired end-clearance between the gears 26*a*, 26*b*. To such end, the spacers 54*a*, 54*b* are film-like and have a defined thickness (e.g. 20 microns) corresponding to the magnitude of desired end-clearance. The respective thicknesses of the spacers 54*a*, 54*b* need not be identical, depending upon the desired end-clearance to be established. The spacers 54*a*, 54*b* are made of a material (e.g. polyvinyl alcohol) that is soluble in a solvent (e.g. cold water). (The spacers 54*a*, 54*b* are shown as separate units but alternatively can be a single unit, especially if their respective thicknesses are identical.) The gear axles 24*a*, 24*b* are then inserted into the bushings 30*a*, 30*b*, the gears 26*a*, 26*b* are inserted into the gear cavity 28, and the gear axles 24*a*, 24*b* are inserted into the bushings 22*a*, 22*b*. The magnet cup 16 is not yet assembled to the housing, but the housing portions 12, 14 are attached together by bonding (see below), by using one or more mechanical fasteners such as screws, clips, or the like (see above), or by using a combination of these techniques.

If the housing portions 12, 14 are assembled together by bonding, the inlet 18 and outlet 20 desirably are temporarily plugged using a material that does not adhere to the adhesive or other bonding agent used (e.g. Teflon plugs for use with an epoxy adhesive. Temporary plugging prevents the inlet 18 and outlet 20 from becoming occluded by adhesive, material flow, creep, or other such consequence of bonding. If an adhesive is used for bonding, the adhesive (e.g. epoxy adhesive) is applied in the zone 56 (FIG. 1(A)) between the wall 29 and end-plate 12. The raised face 46 is inserted into the gear cavity 28, and the plates 12, 14 are urged toward each other (usually with a specified force, called "preload") until the raised face comes in contact with the films 54*a*, 54*b*. Without disturbing the assembly, the adhesive is cured at an appropriate curing temperature for the particular adhesive (e.g. 195° C.) for a suitable time (e.g., 13 minutes). After achieving full cure of the adhesive, the solvent is circulated through the pump-head (while rotating the gears) to dissolve the spacers 54*a*, 54*b*, to produce the desired end-clearance between the gears 26*a*, 26*b* and the housing portions 12, 14 in the gear cavity 28. Afterward, the inlet and outlet are unplugged.

The housing portions 12, 14 can be bonded together after they, as a result of application of preload, are actually in contact with each other. Alternatively, especially if adhesive is used for bonding, sufficient adhesive can be applied to fill space between the housing portions 12, 14 left after applying the preload.

After assembling the housing portions as described above, the magnet 38 and magnet cup 16 are assembled to the pump-head. In the finished pump-head assembly 10, the adhesive used for bonding the plates 12, 14 together assumes whatever thickness (in the axial direction) to take up tolerances in the zone 56 between the wall 29 and the end-plate 12, while the films 54*a*, 54*b* provide the desired end-clearance for the gears 26*a*, 26*b* relative to the plates 12, 14.

In an alternative configuration, the housing portions plates 12, 14 are made of metal such as brass or stainless steel. After assembling the gears 26*a*, 26*b* in the gear cavity 28, the housing portions 12, 14 are bonded together using a bonding technique suitable for metal, such as brazing or soldering, use of mechanical fasteners, or a combination of these techniques.

In another alternative configuration, the plates 12, 14 are made of a thermally bondable material such as, but not limited to, any of various plastics. After assembling the gears 26*a*, 26*b* in the gear cavity 28, the plates 12, 14 are bonded together using a thermal-bonding technique, such as heat-and-press, sonic welding, or the like. Thermal bonding can be combined or augmented with adhesive bonding, such as using local application of heat to achieve curing of the adhesive and/or to achieve bonding together of the plates.

The particular configurations of the housing portions 12, 14 described above are not intended to be limiting. The housing can be defined using any of various combinations and configurations of housing portions, so long as they allow the gears (or other rotary member(s)), bushings, and other parts to be assembled inside the cavity 28. This usually requires that the housing comprise multiple portions that are assembled together after inserting the rotary member(s). For example, the housing portions 12, 14 can be substantially the same size and shape (but be mirror images of each other).

It is also realized that the magnet 38, being a rotary member situated inside the cavity in which pumped fluid circulates, could also be provided with a spacer to establish a desired end-clearance of the magnet 38 inside the magnet cup 16. Such a spacer would be analogous to a spacer 54*a*, 54*b* described above for the gears.

Second Representative Embodiment

Figure 2A:
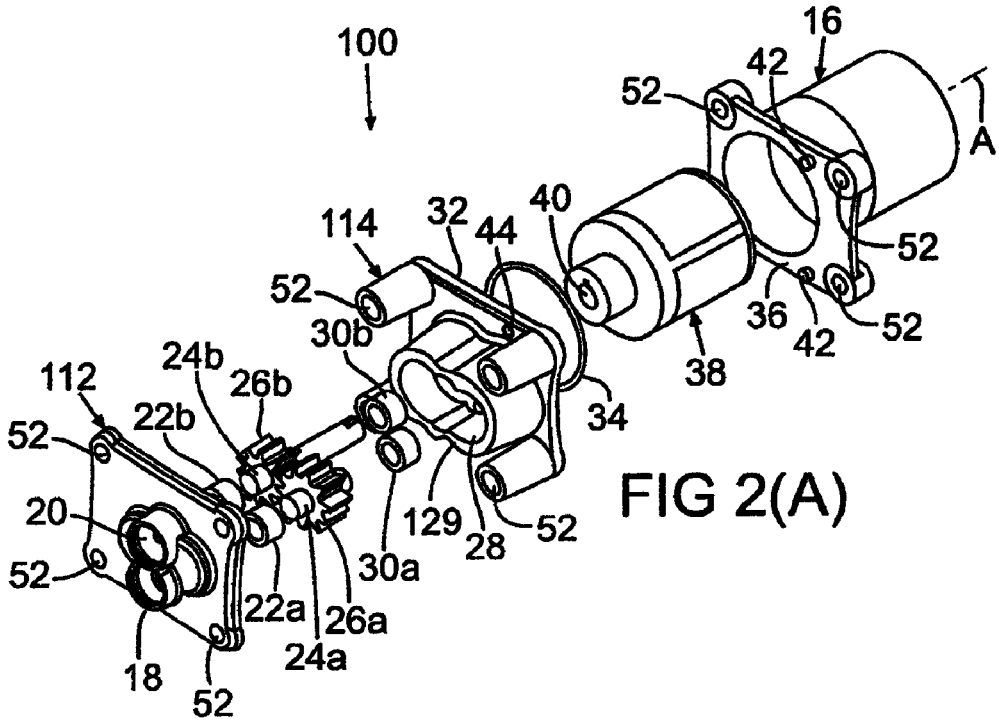
FIG. 2(A) is a perspective, axially exploded view of a gear pump-head according to the second representative embodiment.
Figure 2B:
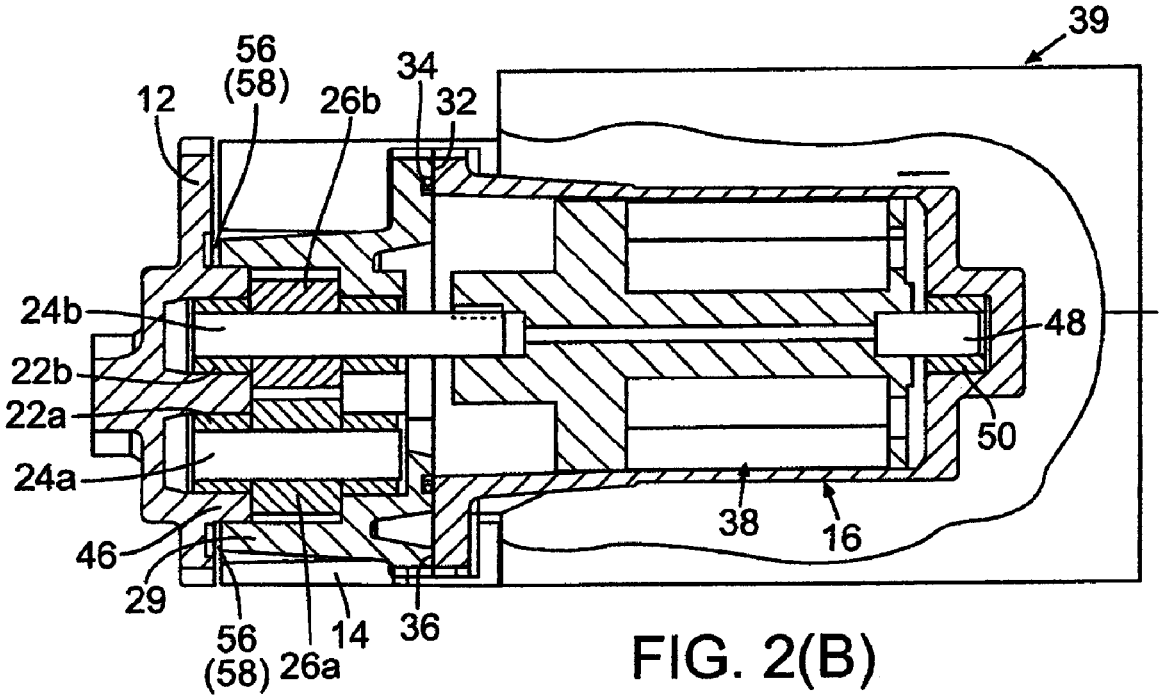
FIG. 2(B) is an elevational section (along the median sagittal plane) of the assembled gear pump-head of the second first representative embodiment.

A second embodiment is shown in FIGS. 2(A)-2(B), which is similar in certain respects to the first embodiment except that the second embodiment does not utilize the soluble spacers 54*a*, 54*b* to establish desired end-clearance. Rather, the second embodiment is made by a method in which, to achieve a desired end-clearance of the rotary member(s) in the housing the rotary members are assembled in the pump-cavity, and the housing portions are assembled while pressing them together axially, followed by running the rotary members, such as under pressure, to remove high-spot interferences and achieve a desired end-clearance.

In FIGS. 2(A) and 2(B), items that are the same as corresponding items shown in FIGS. 1(A) and 1(B) have the same respective reference numerals and are not described further. The housing portions (end-plate 112 and cavity-plate 114) in the second embodiment are slightly different than in the first embodiment and thus have different reference numerals than in the first embodiment.

Figure 2C:
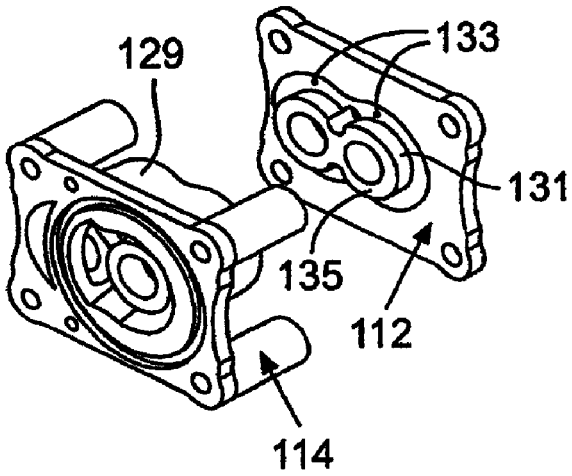
FIG. 2(C) is a perspective view of two housing portions placed in position for assembly, according to the second representative embodiment.

To manufacture a pump-head assembly 100 using a method according to the second embodiment, the gear axles 24*a*, 24*b* are inserted into the bushings 30*a*, 30*b*, the gears 26*a*, 26*b* are inserted into the gear cavity 28, and the gear axles 24*a*, 24*b* are inserted into the bushings 22*a*, 22*b* to form a pump-head. (The magnet cup 16 is not attached yet.) The inlet 18 and outlet 20 are temporarily plugged, and an adhesive 58 (e.g. epoxy adhesive) is applied in the zone 56 (FIG. 1(A)) between the wall 29 and end-plate 12. Details are shown in FIG. 2(C), which shows the end-plate 112 and the cavity-plate 114. The cavity-plate 114 defines the cavity wall 129, and the end-plate 112 defines a "figure-eight" raised portion 131 (see "raised face" 46 in FIG. 2(B)) that, during assembly of the plates 112, 114, is inserted into the gear cavity 28. Surrounding the raised portion 131 is a glue zone 133 to which the adhesive 58 is applied. The raised portion 131 includes a "top" surface 135.

Figure 2D:
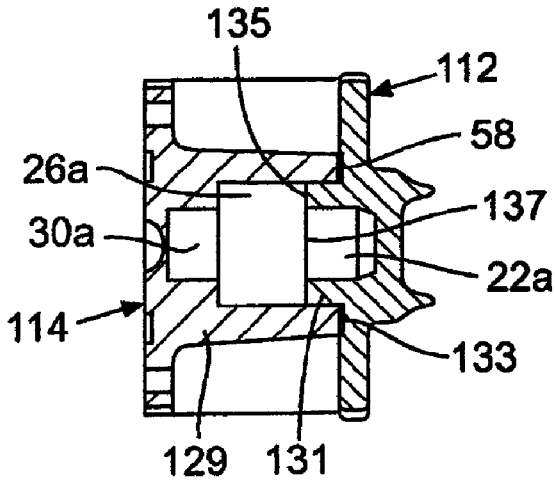
FIG. 2(D) is an elevational section (along the median sagittal plane) of the assembled housing of the second representative embodiment.

After inserting the raised portion 131 (raised face 46) into the gear cavity 28, the plates 112, 114 are urged toward each other until the top surface 135 of the raised portion 131 contacts the opposing surfaces 137 of the gears 26*a*, 26*b* (see FIG. 2(D)). The resulting pump-head is placed in a press or the like and subjected to an axial compression load (called "preload," e.g. 40 pounds) for a suitable time (e.g. 5 seconds) to seat the components together. The adhesive 58 is cured by exposure to a suitable curing temperature (e.g., 195° C.) for a suitable time (e.g., 13 minutes). After fully curing the adhesive 58, the pump-head is placed in a run-in device comprising a specified orifice for producing a desired back pressure in the pump-head (e.g., 40 psi back pressure) during run-in. A drive mechanism is coupled to the gear axle 24*b* protruding from the cavity-plate 114 and actuated to rotate the driving gear 26*a* for a suitable time (e.g., 1 minute). The resulting contra-rotation of the gears 26*a*, 26*b* against the side surfaces of the plates 112, 114 removes internal interference between the gears, end-plate 112, and cavity-plate 114, leaving the desired end-clearances inside the pump-cavity 28. After run-in, the magnet cup 16 and magnet 38 are assembled to the pump-head.

Thus, in the finished pump-head assembly 100, the adhesive 58 assumes whatever thickness (in the axial direction) to occupy the clearance (including tolerance stack-up) in the zone 56 between the wall 129 and the end-plate 112, while the run-in step provides the desired end-clearance for the gears relative to the plates 112, 114.

It will be understood that "gear" as used herein encompasses rotary members configured as conventional pump gears as well as any of various other rotary members having lobes, teeth or the like that interdigitate with the same of a second such member to produce, when contra-rotated relative to each other, fluid flow.

The magnet 38 is driven by a stator 39 or analogous device. The stator 39 is placed outside the magnet cup 16 so as to surround the magnet cup (and magnet 38) in a coaxial manner. A typical stator comprises wire windings (not detailed) associated with an iron core, wherein the core surrounds the magnet cup. The windings are selectively energized by electronics. Power is supplied to the electronics to energize the stator 39 to cause axial rotation of the magnet 38. Rotation of the magnet 38 rotates the driving gear 26*b*, which contra-rotates the driven gear 26*a*. This co-rotation of the gears 26*a*, 26*b* urges flow of liquid through the pump-cavity 28.

The second representative embodiment may be combined, if desired or necessary, with the first representative embodiment, wherein the method for manufacturing the pump-head comprises not only the features described above in the second embodiment but also the use of soluble spacers as an aid to establishing a desired end-clearance of the rotary member(s) inside the housing.

Either of the first and second representative embodiments may be utilized in the manufacture of an offset-drive, magnetically driven, gear pump-head as discussed in U.S. Pat. No.

7,267,532 to Krebs, incorporated herein by reference, especially columns 7-13 and FIGS. 1-6 of that patent.

It will be appreciated that principles described above in connection with the first and second representative embodiments are advantageously applied to miniature pump-heads, but are not limited to such pump-heads. Establishing a specified end-clearance on a consistent basis in manufacturing pump-heads is an important objective, even with pump-heads that are larger than "miniature." "Miniature" pump-heads are generally 1 $in^3$ or less in volume.

It will also be understood that use of a soluble spacer for establishing clearance for a rotary or other moving pump member inside a housing is not limited to establishing end-clearance. It is possible that a soluble spacer may be configured and used during manufacture to establish, for example, a desired radial clearance or other clearance than end-clearance.

Hydraulic Circuit

Figure 3:
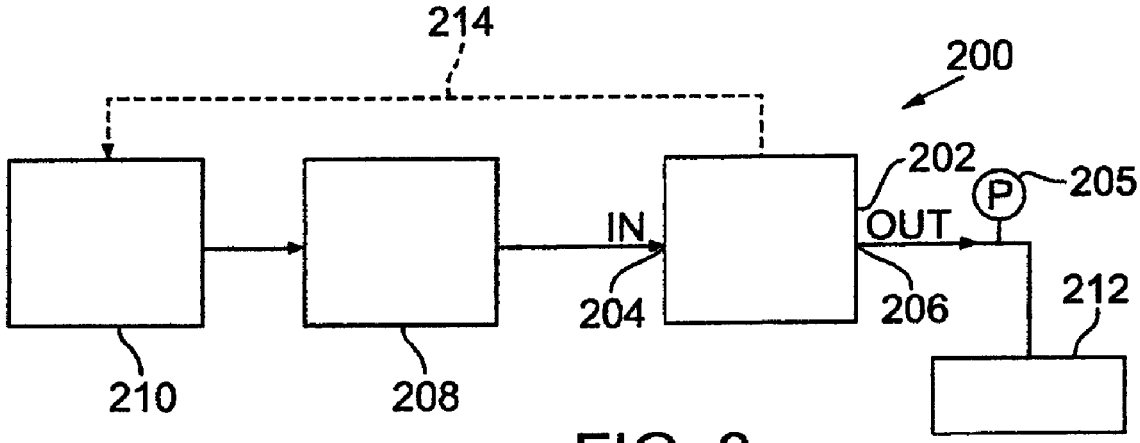
FIG. 3 is a schematic diagram of an exemplary hydraulic circuit with which a pump-head as described herein can be used.

It will be understood that a pump-head manufactured by methods such as the embodiments described above can be connected to and used with any of various types of hydraulic circuits. An example circuit 200 is shown in FIG. 3, which includes a pump 202 having an inlet 204 and an outlet 206. The outlet 206 can include a pressure sensor 205. The inlet 204 is situated downstream of a filter 208, which is situated downstream of a tank 210 serving as a reservoir for liquid to be pumped by the pump 202. The outlet 206 is hydraulically connected to a downstream destination 212 at which pumped liquid is discharged from the circuit or otherwise used. If desired, the circuit 210 can include a return line 214 for returning liquid to the tank 210 that is not actually discharged at the destination 212.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. We therefore claim as our invention all that comes within the scope and spirit of these claims.

What is claimed is:

1. A method for manufacturing a pump-head including a housing enclosing at least one rotary member, the method comprising:

providing a first housing portion and a second housing portion that collectively, when assembled together, define a pump-cavity that accommodates the at least one rotary member;

assembling the at least one rotary member into the housing portions;

placing a soluble spacer of a defined thickness, corresponding to a desired clearance, in contact with a surface of the at least one rotary member facing a corresponding surface of at least one of the housing portions;

attaching the first and second housing portions together to form the pump-cavity containing the at least one rotary member; and dissolving the soluble spacer to provide the desired clearance of the at least one rotary member in the pump-cavity.

2. The method of claim 1, wherein the attaching step comprises urging the first and second housing portions toward each other to establish a specified preload to the housing until stopped by the soluble spacer.

3. The method of claim 1, wherein:

the at least one rotary member comprises multiple pump gears; and the assembling step comprises mounting the pump gears in the pump-cavity before attaching the first and second housing portions together.

4. The method of claim 1, wherein the desired clearance is a desired end-clearance of the at least one rotary member relative to a corresponding location on an inside surface of the pump-cavity.

5. The method of claim 1, wherein:

the at least one rotary member comprises first and second gears intermeshed with each other in the pump-cavity; and the desired clearance is a desired end-clearance of the gears relative to corresponding locations on an inside surface of the pump-cavity.

6. The method of claim 5, wherein placing the soluble spacer comprises placing a soluble washer coaxially with a respective gear to establish the desired end-clearance between a side of the gear and the corresponding inside surface of the pump-cavity.

7. The method of claim 1, wherein the attaching step comprises bonding the first and second housing portions together.

8. The method of claim 7, wherein bonding comprises:

applying adhesive to mating surfaces of the first and second housing portions; and after attaching the first and second housing portions together, curing the adhesive.

9. The method of claim 8, further comprising applying a preload to the first and second housing portions before curing the adhesive.

10. The method of claim 1, further comprising mounting a rotation device to the pump-head such that the rotation device is coupled to the at least one rotary member, the rotation device being energizable in a manner causing rotation of the at least one rotary member in the pump-cavity.

11. The method of claim 10, wherein:

the rotation device comprises a rotatable magnet coupled to at least one rotary member and a magnet driver magnetically coupled to the rotatable magnet; and the assembling step comprises enclosing the magnet in a magnet cup and mounting the magnetic cup to at least one of the housing portions such that the magnet cup is in hydraulic communication with the pump-cavity.

12. The method of claim 1, wherein dissolving comprises circulating a solvent in the pump-cavity to dissolve the spacers.

13. The method of claim 12, further comprising rotating the at least one rotary member while circulating the solvent.

14. A method for manufacturing a gear pump-head, comprising:

providing a first housing portion and a second housing portion that collectively, when assembled, define a gear-cavity;

assembling a driving gear and a driven gear into the housing portions;

placing a soluble spacer, having a defined thickness corresponding to a desired end-clearance, in contact with at least one surface of the gears facing at least one of the housing portions in the gear cavity;

attaching the first and second housing portions together to form the gear-cavity containing the gears, the attaching including urging the first and second housing portions toward each other until stopped by the soluble spacer; and dissolving the soluble spacer to provide the desired end-clearance of the gears in the gear-cavity.

15. The method of claim 14, further comprising:

applying adhesive to mating surfaces of the first and second housing portions; and after attaching the first and second housing portions together, curing the adhesive.

16. The method of claim 14, further comprising:

mounting a rotatable magnet to the driving gear; and enclosing the magnet in a magnet cup mounted to at least one of the housing portions.

* * * * *

UNITED STATES PATENT AND TRADEMARK OFFICE

CERTIFICATE OF CORRECTION

PATENT NO. : 8,186,055 B2
APPLICATION NO. : 12/201842
DATED : May 29, 2012
INVENTOR(S) : Krebs et al.

It is certified that error appears in the above-identified patent and that said Letters Patent is hereby corrected as shown below:

In the Specification:

Column 1, line 67, "other suitable is" should read --other suitable material is--

Column 3, line 19, "alias methods" should read --alia, methods--

Column 4, line 35, "magnetic cup" should read --magnet cup--

Column 5, line 3, "yet" should read --In yet--

Column 5, lines 57-58, "second first representative" should read --second representative--

Column 6, line 35, "method." should read --methods.--

Column 6, line 43, ""down,", "upper,"" should read --"down," "upper,"--

Column 7, line 18, "etc., are used." should read --etc.--

Column 7, line 67, "cavity 38" should read --cavity 28--

Column 8, line 49, "epoxy adhesive. Temporary" should read --epoxy adhesive). Temporary--

Column 8, line 53, "(FIG. 1(A))" should read --(FIG. 1(B))--

Column 10, line 4, "(FIG. 1(A))" should read --(FIG. 2(B))--

Column 11, line 31, "circuit 210" should read --circuit 200--

In the Claims:

Column 12, line 46, claim 11 "magnetic cup" should read --magnet cup--

Signed and Sealed this
First Day of April, 2014

Michelle K. Lee

Michelle K. Lee
*Deputy Director of the United States Patent and Trademark Office*